US006186189B1

(12) United States Patent
Gheysen

(10) Patent No.: US 6,186,189 B1
(45) Date of Patent: Feb. 13, 2001

(54) FALSE AND TRUE BOUCLÉ FABRICS, AND A METHOD FOR THE PRODUCTION OF SUCH FABRICS

(75) Inventor: Nico Gheysen, Sint Eloois Winkel (BE)

(73) Assignee: N.V. Michel Van de Wiele, Kortrijk/Marke (BE)

( * ) Notice: Under 35 U.S.C. 154(b), the term of this patent shall be extended for 0 days.

(21) Appl. No.: 09/337,249

(22) Filed: Jun. 22, 1999

(30) Foreign Application Priority Data

Jul. 22, 1998 (BE) ..... 09800548

(51) Int. Cl.[7] ..... D03D 27/04

(52) U.S. Cl. ..... 139/392; 139/383 R; 139/37; 139/435.1

(58) Field of Search ..... 139/37, 435.1, 139/383 R, 404, 418, 391, 392, 402

(56) References Cited

FOREIGN PATENT DOCUMENTS 42 43 237 * 8/1994 (DE) .
43 12 235 * 10/1994 (DE) .

* cited by examiner

*Primary Examiner*—John J. Calvert
*Assistant Examiner*—Robert H. Muromoto, Jr.
(74) *Attorney, Agent, or Firm*—James Creighton Wray; Meera P. Narasimhan

(57) ABSTRACT

A method for manufacturing fabrics with a rib structure, in particular false bouclé fabrics is provided. On a weaving machine two series of warp threads (4, 5, 6, 10, 11); (7, 8, 9, 12, 13) are provided for weaving a respective fabric (21); (22). In successive insertion cycles, in each case, at least three weft threads (1), (2), (3) are inserted one above the other between the warp threads, so that in each case a set of weft threads (3), (2); (1), (2) running one above the other are inwoven by the warp threads (5), (6); (8), (9) of one of the other two series, and at least one weft thread (3); (1) is inwoven by the warp threads (8), (9); (5), (6) of the other series, so that two fabrics (20), (21) with a rib structure are woven simultaneously. A method for manufacturing loop pile fabrics is provided. Two fabrics (20); (21) are manufactured according to the above described method, and at least one weft thread (2) of each set of weft threads (1), (2); (3) (2) running one above the other functions as loop weft thread and is removed so that the pattern warp threads (10), (11); (12), (13) running above these sets form loops. The fabrics are manufactured according to the above mentioned methods, in particular false and true bouclé fabrics.

16 Claims, 1 Drawing Sheet

FALSE AND TRUE BOUCLÉ FABRICS, AND A METHOD FOR THE PRODUCTION OF SUCH FABRICS

BACKGROUND OF THE INVENTION

Figure 1:
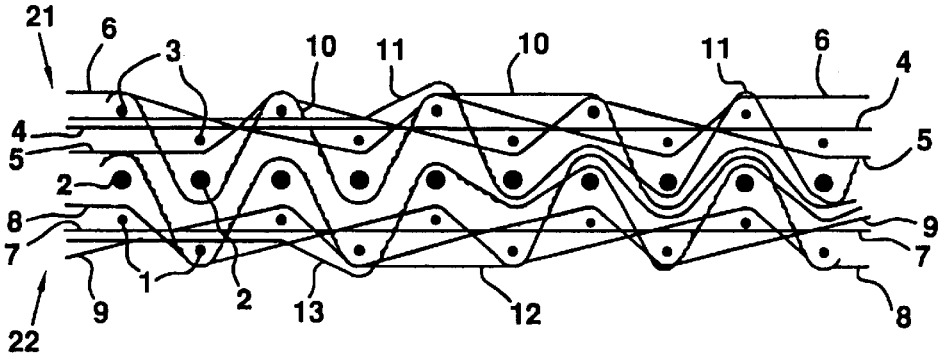

This invention relates to a method for the production of fabrics with a rib structure, in particular of false bouclé fabrics, whereby on a weaving machine weft threads are inwoven by a series of warp threads so that a fabric is formed with sets of at least two weft threads running one above the other, and pattern warp threads which are alternately interlaced in the fabric and are rib-formingly passed around a set of weft threads.

This invention also relates to fabrics with a rib structure which are manufactured according to such a method, in particular false bouclé fabrics, comprising weft threads which are inwoven by a series of warp threads, sets of at least two weft threads running one above the other, and pattern warp threads which are alternately interlaced in the fabric and run rib-formingly above a set of weft threads.

A fabric with a rib structure which approximates the appearance of a loop pile fabric or bouclé fabric, is called a false bouclé fabric.

According to a known weaving method for manufacturing a false bouclé fabric, which has the above mentioned characteristics, tension warp threads are provided and in each weft insertion cycle on the weaving machine two weft threads are simultaneously inserted one above the other. In successive insertion cycles the two weft threads are in relation to the tension warp threads alternately inserted along the upper side of the fabric and along the back of the fabric.

Two pattern warp threads with a different color are provided in order to be able to make a design or a pattern visible with the two colors along the upper side of the fabric.

In several systems of warp threads a first pattern warp thread is alternately brought above the two weft threads located along the upper side of the fabric and interlaced between the two weft threads located along the back of the fabric, in order to implement a rib structure on the upper side of the fabric and to form the design or pattern, while a second pattern warp thread is alternately interlaced between the two weft threads located along the upper side of the fabric and is brought below the two weft threads located along the back of the fabric. The color of the second pattern warp thread is then visible on the back of the fabric. The second pattern warp thread forms a rib structure on the back of the fabric. With these fabrics the weft threads are inwoven by the pattern warp threads. With each insertion cycle a rib line is produced (alternately along the upper side and along the back of the fabric).

Both the upper side and the back of the fabric have a rib structure. On the back of the fabric a type of negative (with swapped colors) is obtained of the two-colored design which is visible on the upper side of the fabric.

Manufacturing fabrics with a rib structure on a weaving machine can only be effected according to the known methods at a moderate productivity.

The purpose of this invention is to provide a method for manufacturing such fabrics, according to which work can be effected on a weaving machine with a considerably higher productivity.

This purpose is achieved because of the fact that according to this invention with a method having the characteristics mentioned in the first paragraph of this specification two series of warp threads are provided for weaving a respective fabric on a weaving machine, and in each insertion cycle of a number of successive insertion cycles, in each case at least three weft threads are inserted one above the other between the warp threads, so that in each case a set of weft threads running one above the other is inwoven by the warp threads of one of the two series, and at least one weft thread is inwoven by the warp threads of the other series, so that two fabrics with a rib structure are woven.

According to the method according to this invention two fabrics can be woven simultaneously on a weaving machine.

Utilizing this method in place of the known methods therefore doubles the productivity.

According to this method in each insertion cycle at least one thicker weft thread is preferably inserted and so inwoven that it is part of a set of weft threads running one above the other.

The thicker weft threads ensure that the sets of weft threads running one above the other take up a greater height in the fabric. Because of this ribs are obtained with a somewhat greater height, which produces a fabric with a more pronounced rib structure.

By utilizing the method according to this invention a number of tension warp threads are preferably provided in each fabric, the sets of weft threads running one above the other are inwoven in the top of the fabric in relation to the tension warp threads, and the pattern warp threads are interlaced in the fabric below weft threads which are inwoven along the back of the fabric in relation to the tension warp threads. Because of this very clearly perceptible ribs are obtained in the fabrics.

According to another preferred method according to this invention whereby in each insertion cycle a thicker weft thread is inserted, in each fabric a number of tension warp threads are provided, of each set of weft threads only the aforesaid thicker weft thread is inwoven along the upper side of the fabric in relation to the tension warp threads, and the pattern warp threads are interlaced in each fabric below weft threads which are inwoven along the top of the fabric in relation to the tension warp threads.

This method makes it possible to weave fabrics with a rib structure with a minimum pattern warp thread consumption and a maximum productivity.

Preferably the method is so implemented that the warp threads of both series alternately inweave a set of weft threads running one above the other. Thus per two successive insertion cycles a rib is obtained on the top of both fabrics.

In the successive insertion cycles in each case for example three weft threads can be inserted simultaneously one above the other.

The method according to this invention is very efficient if the two fabrics are woven one above the other with the top directed toward each other, whereby the weft thread inserted on the top insertion level is in each case inwoven by warp threads of the top fabric, the weft thread inserted on the bottom insertion level is in each case inwoven by warp threads of the lower fabric, and around the weft threads which are inserted on the middle insertion level in successive insertion cycles alternately a pattern warp thread of the top fabric and a pattern warp thread of the bottom fabric is passed around.

In order to form a design or pattern on the upper side of a fabric pattern warp threads must be visible in one location in the fabric and not in the other location. A pattern warp thread which may not be visible in a specific location along the top of the fabric is then inwoven in the fabric. These (parts of) pattern warp threads are called dead or non-pattern-forming (parts of) pattern warp threads.

According to this invention non-pattern-forming pattern warp threads, or parts thereof, preferably, married to the tension warp threads, are inwoven stretched in the fabric. Thus for these non-pattern-forming (parts of) pattern warp threads an extremely low thread consumption is achieved.

The non-pattern-forming pattern warp threads or parts thereof, can also be alternately undulatingly inwoven in the fabric running between two weft threads of a set located one above the other and below a weft thread. In that manner a greater rib height is obtained and the rib structure in the fabrics becomes clearer.

According to a greatly preferred method according to the invention backing weft threads are inwoven by binding warp threads so that two backing fabrics are formed, work is so performed that each set of weft threads comprises a backing weft thread and a pattern weft thread not inwoven in this backing fabric, and pattern warp threads are alternately passed around a pattern weft thread and interlaced in a backing fabric by a backing weft thread located between two sets of weft threads.

It is clear that both the above specification and the methods described in the claims and the fabrics with a rib structure, in particular the false bouclé fabrics, which are manufactured according to one of these methods, are covered by the protection claimed by this patent application.

In such a fabric that is particularly preferred, backing weft threads are inwoven by binding warp threads so that a backing fabric is formed, each set of weft threads located one above the other comprises a backing warp thread and a pattern weft thread extending there above and not inwoven in the backing fabric, pattern warp threads are alternately passed around a pattern weft thread and interlaced in the backing fabric by a backing weft thread located between two sets of weft threads.

By utilizing the above described method for the production of fabrics with a rib structure, and by afterward removing at least one of the weft threads of each set, fabrics are obtained in which the pattern warp threads (which initially ran rib-formingly above the sets of weft threads) now form loops on the upper side of the fabrics. Thus on the basis of the inventive idea of the above specified method a method can also be provided for manufacturing loop pile fabrics (bouclé fabrics) with a high productivity.

Methods exist for manufacturing loop pile fabrics, whereby on a weaving machine two series of warp threads are provided, and weft threads are inserted between the warp threads so that a top and a bottom fabric are woven with loop warp threads which are alternately interlaced in the fabric and are loop-formingly passed around a loop weft thread, and whereby the loop weft threads are subsequently removed so that two loop pile fabrics are obtained simultaneous.

According to a number of known methods the weft insertion capacity of the weaving machines is not however utilized to a maximum. According to other known methods work is performed with a rather low productivity.

In order to remedy these and other disadvantages of the known methods, according to the method according to this invention two fabrics are manufactured according to one of the methods described above (and in claims 1 through 9), whereby at least one weft thread of each set of weft threads running one above the other functions as loop weft thread and is removed so that the pattern warp threads running above these sets form loops.

It is preferably the top weft thread of each set (the pattern weft thread) which is removed.

Preferably backing weft threads are inwoven by binding warp threads so that two backing fabrics are formed, work is so performed that sets of at least two weft threads running one above the other comprise a backing weft thread and a loop weft thread not inwoven in this backing fabric, and loop warp threads are alternately passed around a loop weft thread and interlaced in a backing fabric by a backing weft thread located between two sets of weft threads.

According to the most efficient method all loop weft threads are inserted on one and the same middle insertion level, a top series of loop-forming elements (e.g. lancets) are provided between the insertion level of the loop weft threads and the insertion level of the weft threads inserted there above, and a bottom series of loop-forming elements is provided between the insertion level of the loop weft threads and the insertion level of the weft threads inserted there under.

This invention will now be further explained in the following specification of a number of methods for manufacturing false bouclé fabrics according to this invention. These methods are only described by way of example and no part of the following specification may therefore be considered as a restriction on the protection claimed by this patent application. In this specification reference is made to the drawings attached hereto and provided with reference numbers in which FIGS. 1, 2 and 3 represent schematic cross-sections according to the direction of the warp threads of false bouclé fabrics, respectively manufactured according to a first, a second and a third variant method according to this invention, and FIG. 4 represents a schematic cross-section in warp direction of a loop pile fabric, during its production according to a method according to this invention with use of lancets.

Figure 2:
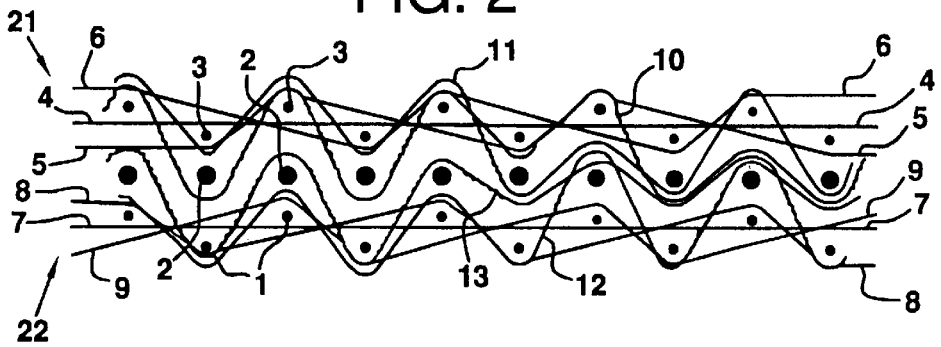
Figure 3:
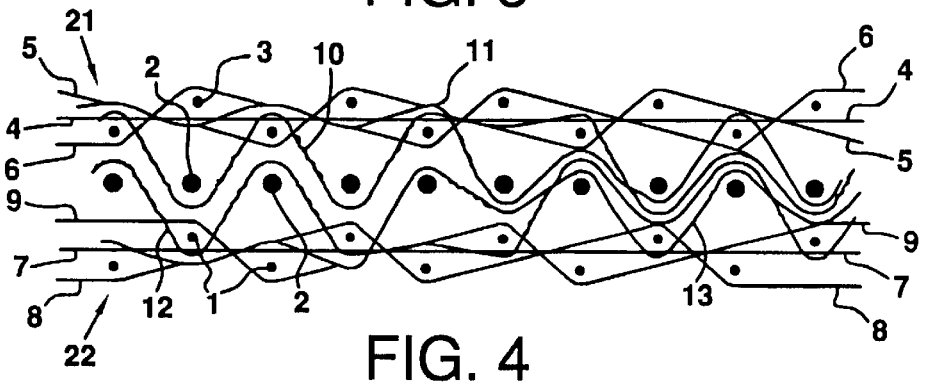
Figure 4:
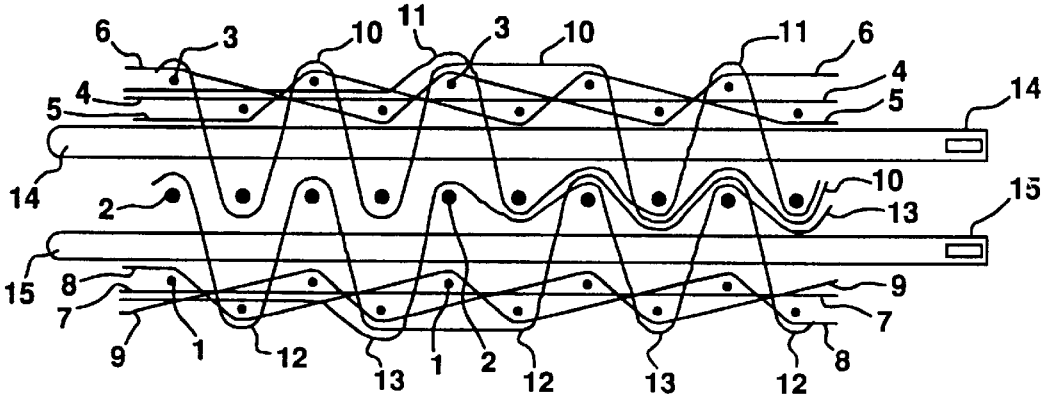

The false bouclé fabrics represented in FIGS. 1, 2 and 3 are manufactured by providing two series of warp threads (4, 5, 6, 10, 11); (7, 8, 9, 12, 13) on a weaving machine with three weft insertion means. Each series of warp threads comprises tension warp threads (4), (7), binding warp threads (5), (6); (8), (9) and pattern warp threads (10), (11); (12); (13), and is provided in order to form a respective fabric by inweaving weft threads (1), (2), (3).

The weft insertion means are provided in order in each insertion cycle to insert three weft threads (1), (2), (3) on respective insertion levels one above the other in respective sheds between the warp threads (4, 5, 6, 10, 11); (7, 8, 9, 12, 13). These sheds are formed with known shed-forming means and the different warp threads are brought with this shed-forming during the successive insertion cycles to such heights that the binding warp threads (5), (6) of one series of warp threads in each case inweave the weft thread (3) inserted on the top insertion level, alternately above and below the tension warp threads (4), so that an upper backing fabric is formed, and so that the binding warp threads (8), (9) of the other series of warp threads in each case inweave the weft thread (1) inserted on the bottom insertion level, alternately above and below the tension warp threads (7), so that a lower backing fabric is formed. The binding warp threads (5), (6); (8); (9) of each backing fabric cross each other repeatedly so that they form successive openings between their intersections and in each opening enclose two weft threads (1); (3) of which one is above the tension warp threads (4), (7) and the other below the tension warp threads (4), (7).

The two fabrics (21), (22) are so manufactured that they are directed toward each other with their top.

The weft threads inserted during successive insertion cycles on the middle insertion level function alternately as pattern weft thread for the upper fabric and as pattern weft thread for the lower fabric whereby the pattern weft thread of each fabric in each case extends above (for the lower fabric) or below (for the upper fabric) a weft thread, which in relation to the tension warp threads is along the top of the fabric.

In each fabric (21), (22) the pattern warp threads (10, 11); (12), (13) are alternately passed around a pattern weft thread (2) and interlaced in the backing fabric by running below (for the lower fabric (22)) or above (for the upper fabric (21)) a weft thread (1), (3) which is inwoven in the backing fabric and is along the back of the fabric in relation to the tension warp threads (4), (7).

The fabric from FIG. 2 differs from that from FIG. 1 because of the fact that the non-pattern-forming parts of the pattern warp threads (10), (11); (12), (13) are not inwoven stretchingly married to tension warp threads (4), (7)—as in FIG. 1—but are undulatingly inwoven whereby they repeatedly run first between a weft thread (1), (3) located along the top of the fabric and an upper pattern weft thread (2) and subsequently run below a weft thread (1), (3) located along the back of the fabric.

Because of this a more pronounced rib structure is obtained.

The fabric according to FIG. 3 differs from the fabric from FIG. 1, because of the fact that the weft thread (1), (3), located below the pattern weft thread (2), of the backing fabric of each fabric is now along the back (in relation to the tension warp threads), while the weft thread (1) (3) which interlaces the pattern warp threads (10), (11); (12), (13) in the backing fabric is now along the top of the fabric (instead of along the back).

Because of this a very low pattern warp thread consumption is achieved.

According to the three variant methods in each insertion cycle a weft thread (2) is inserted on the middle insertion level which is thicker than the two other weft threads (1), (3). Because of this a greater rib height and therefore a more conspicuous rib structure is obtained in the fabric.

This method (see FIG. 4) can also be utilized on a weaving machine while a top series of lancets (14) extending in the warp direction is provided on the weaving machine between the upper backing fabric (3, 4, 5, 6) and the pattern weft threads (2), and a bottom series of lancets (15) extending in the warp direction is provided between the lower backing fabric (1, 7, 8, 9) and the pattern weft threads (2).

The lancets (14) of the top series are next to each other between the top and the middle insertion level of the weft insertion means. The lancets (15) of the bottom series are next to each other between the middle and the bottom insertion level.

In each reed tooth two lancets (14), (15) are therefore provided one above the other.

By subsequently removing the pattern weft threads (2) two loop pile fabrics are obtained.

What is claimed is:

1. A method for manufacturing fabrics with a rib structure, on a weaving machine comprising forming a fabric with weft threads and a series of warp threads, sets of at least two weft threads running one above the other, pattern warp threads alternately interlaced in the fabric and rib-formingly passed around a set of weft threads, weaving a fabric with two series of warp threads, wherein in each insertion cycle of a number of successive insertion cycles, in each case, at least three weft threads are inserted one above the other between the warp threads such that in each case a set of weft threads running one above another are inwoven by the warp threads of one of the two series, and at least one weft thread is inwoven by the warp threads of the other series thereby weaving two fabrics a rib structure.

2. The method of claim 1, wherein in each insertion cycle at least one thicker weft thread is inserted and inwoven such that it is part of a set of weft threads running one above the other.

3. The method of claim 1, wherein a number of tension warp threads are provided in each fabric such that the sets of weft threads running one above the other are inwoven in the top of the fabric in relation to the tension warp threads and wherein the pattern warp threads are interlaced in the fabric by weft threads inwoven along a back of the fabric in relation to the tension warp threads.

4. The method of claim 1, wherein in each fabric a number of tension warp threads are provided, and wherein of each set of weft threads only a thicker weft thread is inwoven along an upper side of the fabric in relation to the tension warp threads and wherein the pattern warp threads are interlaced in each fabric by weft threads which are inwoven along the top of the fabric in relation to the tension warp threads.

5. The method of claim 1, wherein warp threads of both series alternately inweave a set of weft threads running one above the other.

6. The method of claim 1, wherein in successive insertion cycles in each case three weft threads are inserted simultaneously one above the other.

7. The method of claim 6, wherein the two fabrics are woven one above the other with a top of each fabric directed toward each other, wherein of the three weft threads inserted per insertion cycle the weft thread inserted on a top insertion level is in each case inwoven by warp threads of the top fabric, and the weft thread inserted on a bottom insertion level is in each case inwoven by warp threads of the lower fabric, and around the weft threads inserted on the middle insertion level in successive insertion cycles alternately a pattern warp thread of the top fabric and a pattern warp thread of the bottom fabric are passed around.

8. The method of claim 1, further comprising inweaving non-pattern-forming pattern warp threads matched to the tension warp threads stretched in the fabric.

9. The method of claim 8, wherein the non-pattern-forming pattern warp threads are alternately undulatingly inwoven in the fabric running between two weft threads of a set located one above the other and below a weft thread.

10. The method of claim 1, further comprising inweaving backing weft threads by binding warp threads for forming two backing fabrics, wherein each set of weft threads comprises a backing weft thread and a pattern weft thread not inwoven in the backing fabric, and wherein pattern warp threads are alternately passed around a pattern weft thread and interlaced in a backing fabric by the backing weft thread located between two sets of weft threads.

11. The method of claim 1, wherein the fabrics are false boucle fabrics.

12. Fabric with a rib structure comprising weft threads inwoven by warp threads, sets of at least two weft threads running one above another, pattern warp threads alternately interlaced in the fabric and running rib-formingly above a set of weft threads, backing weft threads inwoven by binding warp threads such that a backing fabric is formed, wherein each set of weft threads located one above the other comprises a backing weft thread and a pattern weft thread extending above and not inwoven in the backing fabric, and pattern warp threads alternately interlaced in the backing fabric by a backing weft thread located between two sets of weft threads and passed around a pattern weft thread.

13. The fabric of claim 12, wherein the fabric is a false boucle fabric.

14. The method for manufacturing loop pile fabrics on a weaving machine comprising two series of warp threads and weft threads are inserted between the warp threads for weaving a top and a bottom fabric with loop warp threads alternately interlaced in the fabric and are loop-formingly passed around a loop weft thread, the loop weft threads subsequently removed so that two loop pile fabrics are obtained simultaneous, the two fabrics being manufactured with at least one weft thread of each set of weft threads running one above the other functioning as loop weft thread and is removed so that the pattern warp threads running above the sets of weft threads form loops.

15. The method of claim 14, wherein the backing weft threads are inwoven by binding warp threads for forming two backing fabrics, sets of at least two weft threads running one above the other comprising a backing weft thread and a loop weft thread not inwoven in the backing fabric, and loop warp threads alternately interlaced in the backing fabric by the backing weft thread located between two sets of weft threads and passed around a loop weft thread.

16. The method of claim 14, wherein the loop weft threads are inserted on a same middle insertion level, a top series of loopforming elements being provided between the insertion level of the loop weft threads and the insertion level of the weft threads inserted there above, and a bottom series of loop-forming elements being provided between the insertion level of the loop weft threads and the insertion level of the weft threads inserted there under.

* * * * *